US009694925B1

(12) United States Patent
Florio

(10) Patent No.: US 9,694,925 B1
(45) Date of Patent: Jul. 4, 2017

(54) METHOD AND SYSTEM FOR FASTENING A COMMUNICATION MESSAGE TO AN ARTICLE

(71) Applicant: Jennifer Marie Florio, Wrentham, MA (US)

(72) Inventor: Jennifer Marie Florio, Wrentham, MA (US)

(73) Assignee: Jennifer M. Florio, Wrentham, MA (US)

( * ) Notice: Subject to any disclaimer, the term of this patent is extended or adjusted under 35 U.S.C. 154(b) by 0 days.

(21) Appl. No.: 14/706,914

(22) Filed: May 7, 2015

Related U.S. Application Data

(60) Provisional application No. 61/989,556, filed on May 7, 2014.

(51) Int. Cl.

| | |
|---|---|
| ***G09F 1/00*** | (2006.01) |
| ***B65B 15/02*** | (2006.01) |
| ***B42D 15/02*** | (2006.01) |
| ***B65B 51/02*** | (2006.01) |
| ***B65B 5/04*** | (2006.01) |

(52) U.S. Cl.
CPC ..... *B65B 15/02* (2013.01); *B42D 15/02* (2013.01); *B65B 5/04* (2013.01); *B65B 51/02* (2013.01)

(58) Field of Classification Search
CPC ..... B65B 15/02
USPC ..... 40/124.06, 663, 665, 673; 383/40; 229/74, 308, 309, 310, 311
See application file for complete search history.

(56) References Cited

U.S. PATENT DOCUMENTS

| | | | | |
|---|---|---|---|---|
| 2,710,095 | A * | 6/1955 | Robins | B42D 15/04 206/525 |
| 3,065,915 | A * | 11/1962 | Samann | A01M 1/2055 116/321 |
| 3,370,779 | A * | 2/1968 | Cole | B65D 63/12 229/125.22 |
| 6,619,539 | B1 | 9/2003 | Schluger | |
| 7,222,446 | B2 | 5/2007 | Foster | |
| D616,930 | S | 6/2010 | Engel | |
| 7,854,369 | B2 | 12/2010 | Keefe | |
| D665,446 | S | 8/2012 | Mayer | |
| 8,322,597 | B2 | 12/2012 | Purcell | |
| D685,843 | S | 7/2013 | Glass | |
| 8,474,163 | B2 | 7/2013 | Rubin | |
| 2006/0062494 | A1 * | 3/2006 | Aptekar | B65D 33/12 383/40 |
| 2006/0151340 | A1 | 7/2006 | Meister | |
| 2007/0201772 | A1 | 8/2007 | Schindele | |
| 2010/0065617 | A1 | 3/2010 | McCormick | |
| 2011/0005109 | A1 * | 1/2011 | Junkins | G09F 1/04 40/124.06 |
| 2012/0090209 | A1 * | 4/2012 | Christopherson | G09F 3/14 40/638 |

* cited by examiner

*Primary Examiner* — Joanne Silbermann

(57) ABSTRACT

A method and system for attaching a communication to a package including a simple, inexpensive solution enabling a person giving a gift to easily and aesthetically display a greeting card on a gift bag without it getting lost in the contents of the gift bag and also including, in another embodiment, attaching a communication to a gift, such as, but not limited to, a bottle of wine or a teddy bear; this solution provides sufficient surface area for a user to write a private message, and including the ability to secure other items, such as, but not limited to, gift cards or money.

1 Claim, 20 Drawing Sheets

METHOD AND SYSTEM FOR FASTENING A COMMUNICATION MESSAGE TO AN ARTICLE

CROSS-REFERENCE TO RELATED APPLICATIONS

This application claims the benefits of provisional patent application Ser. No. 61/989,556, filed on May 7, 2014, the entire contents of which are incorporated here by reference.

STATEMENT REGARDING FEDERALLY SPONSORED RESEARCH OR DEVELOPMENT

Not Applicable.

TECHNICAL FIELD

The present invention generally relates to the field of offering gift items accompanied by a greeting card enclosed in an envelope, and more particularly, to attaching a greeting card enclosed in an envelope to an article.

BACKGROUND

In today's fast paced society many people are choosing to use gift bags over gift-wrap as a means to present offerings. When using a gift bag tissue paper is often used to both conceal and to display the item. A common dilemma that many people face is figuring out what to do with a greeting card. By default most people place the greeting card inside the gift bag, with all of its contents, hoping that it is discovered. Location of the greeting card is even more critical if something of value is inside, such as money or a gift card. Additionally, if a greeting card becomes separated from the gift bag the recipient is unsure of whom the gift is from.

It is common knowledge that many gift bags include a small, attached tag used primarily to identify the gift giver and the recipient. There is not sufficient surface area to write a message on the tag. The tag is not secured in an envelope and therefore what is written is not private, nor can money or a gift card be enclosed. Additionally, many people forego writing on the gift tag so that the gift bag can be reused. There are also tiny adhesive cards available that are meant to stick onto the side of the gift bag or present. Similar to the gift bag tag these adhesive tags have limited space to write a greeting, and are not enclosed in an envelope to allow for a private message and securing valued items. Furthermore, if they become unstuck identifying information is lost and the gift bag may become damaged rendering it not reusable. Gift givers have also resorted to taping a greeting card to the gift bag, which is not aesthetically pleasing, and can also damage the gift bag.

Another available option, as proposed by Schindele, is a gift bag that has an attached pocket on the front for insertion of the greeting card. If using this option a buyer must locate a greeting bag that is not only the right size, color, and design, but also with a pocket. These bags are not as readily found as standard gift bags, and can be more expensive than simple generic gift bags.

Meister proposed integrating magnets into the greetings card as a means to affix the card to the gift bag, however it can be difficult to find such innovation at popular greeting card venues. Rubin received a patent on the development of a "greeting bag" which enables the buyer to mix and match gift bags, greeting cards, and attachment mechanisms from different sets. An example of an attachment mechanism would be a slot in the front of a gift bag in which the card could slide into. The interdependence of each component in this method could pose a problem if the buyer likes, and, or can find only one of the parts.

In addition to the problem of affixing greeting cards to gift bags, many have found that this same dilemma applies when a gift giver chooses to give a bottle of wine or spirits. The contours of wine bottles can make affixing a greeting card with adhesives difficult and even unsightly. Often the greeting card is delivered separately for lack of a reliable solution for fastening it to the bottle.

Methods of presenting greeting cards with gift bags herertofore known suffer from a number of disadvantages:

(a) Dropping a loose greeting card in a gift bag filled with all of the paraphernalia inside can lend to the loss or the discarding of the greeting card and its contents.

(b) Small attached gift bag gift tags do not have sufficient surface area for writing messages, do not include an envelope for privacy, and do not allow for enclosure of money or gift cards, and are often not used to preserve the ability to re-use the gift bag.

(c) Affixing a greeting card to the side of a gift bag with adhesives is not aesthetically pleasing, and can cause damage to the gift bag during removal rendering the gift bag not reusable.

(d) Small adhesive tags do not have sufficient surface area for writing messages, do not include an envelope for privacy, do not allow for enclosure of money or gift cards, and are often not used to preserve re-use of the gift bag.

(e) Gift bags with front pockets for insertion of greeting cards are not as commonly found, are more expensive, and can be limiting.

(f) Greeting cards that incorporate magnets for fastening ability are not as readily found, and are more expensive due to the cost of added materials.

(g) Current greeting card options do not attach easily to contoured gift items such as such as a bottle of wine.

Therefore it is desirable to provide a simple and inexpensive solution to affix a greeting card secured in an envelope, to any gift. This long-felt, unmet need is solved by the below invention.

SUMMARY OF THE INVENTION

In general, in an aspect, a system of presenting a greeting card with an article including a greeting card insert configured for inscribing a message, a tie fastener configured to attach to said greeting insert, and an envelope configured for enclosing said greeting insert wherein said envelope has an opening for said tie, ends of said tie protrude through the opening, and said insert has an element for attaching said tie.

In general, in another aspect, the invention relates to a method of presenting a greeting card with an article that includes providing a greeting card insert configured for inscribing a message, providing a tie fastener configured to be attached to said greeting insert, providing an envelope configured for enclosing said greeting insert, with said envelope having an opening for said tie, attaching said tie to said greeting insert, inserting said greeting insert into said envelope with said tie protruding through the opening, closing said envelope with said tie protruding through the opening and fastening said tie to the article.

The present invention generally focuses on a system of presenting a gift via a gift bag, a wrapped package, or a bottle several advantages of which are: the greeting card stays fastened and in full view while enclosed in the envelope, it does not get lost in the contents of the bag, it can be easily detached and reattached at will, it is of substantial size for writing messages, messages remain private secured in an envelope, money or gift cards can be secured inside the envelope, it can remain fixed to the gift package after opening so that the receiver can keep track of whom the gift is from, the presentation is aesthetically pleasing, easy removal preserves the gift bag, if any, for reuse, its presentation invites the gift receiver to open the greeting card first which is customary. Particularly, in its various embodiments and implementations, the invention provides for practically unlimited combinations of greeting set components, improved aesthetic packages, and a simplified process of attaching the greeting card to its accompanied article.

Aspects and advantages of the invention will be set forth in part in the following description, or may be obvious from the description, or may be learned through practice of the invention. Variations and modifications can be made to these exemplary embodiments of the present disclosure. Other embodiments and aspects of the invention are described in detail herein and are considered a part of the claimed invention. Such other embodiments and aspects can be understood with reference to the following detailed description, accompanying drawings, and claims.

BRIEF DESCRIPTION OF THE FIGURES

In the drawings, like reference characters generally refer to the same parts throughout different views. Closely related figures have the same number but different alphabetic suffixes. A full and enabling disclosure of the present invention, including the best mode thereof, directed to one of ordinary skill in the art, is set forth in the specification, which makes reference to the appended figures, which are not necessarily drawn to scale, and wherein.

DETAILED DESCRIPTION OF THE PREFERRED EMBODIMENT

Figure 1:
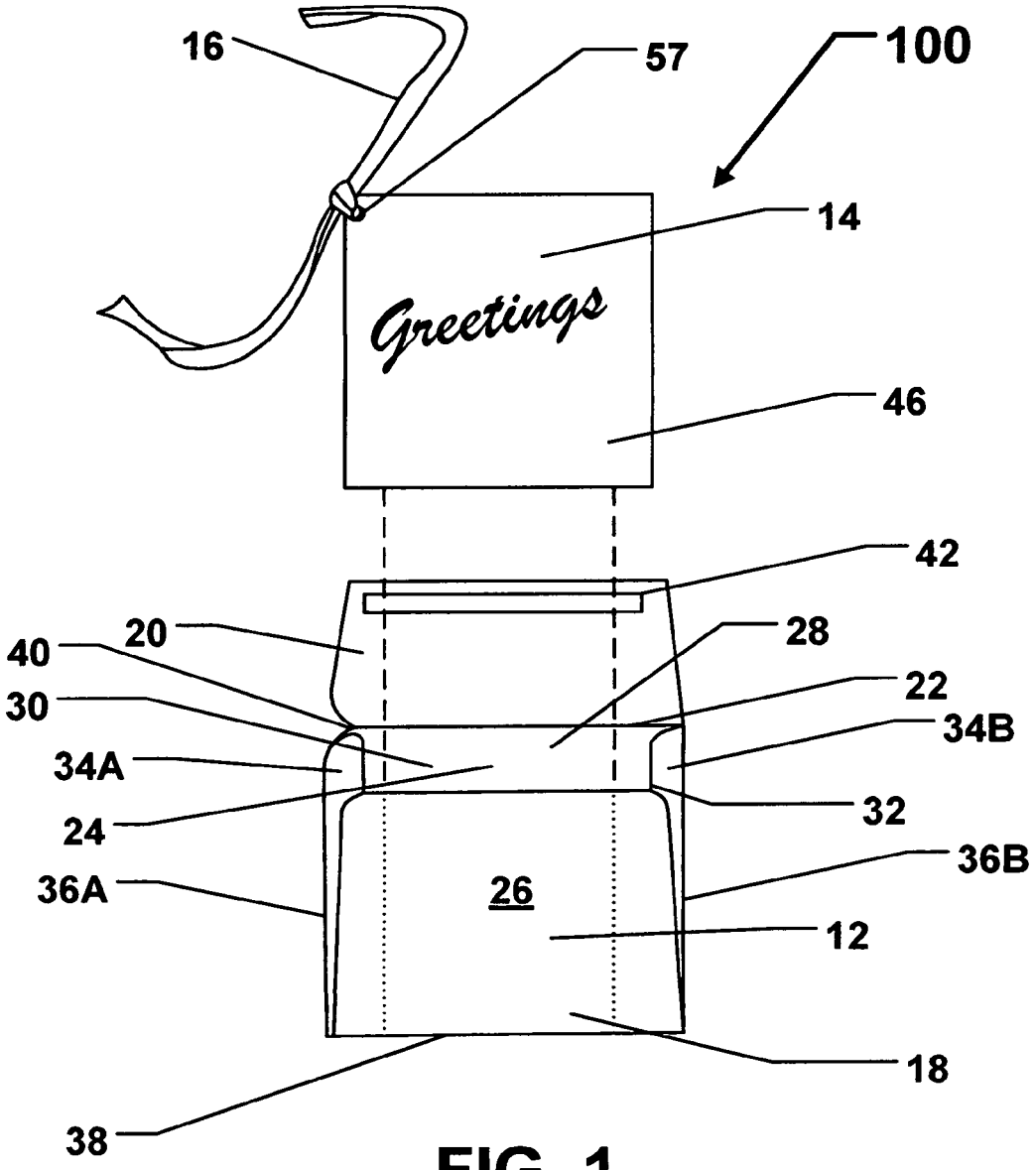
FIG. 1. A View Of An Open envelope, A Greeting Insert And A Tie Fastener Of An Embodiment According To The Present Invention FIG. 2. A Flat Pattern Of The Envelope From FIG. 1

Reference now will be made in detail to embodiments of the invention, one or more examples of which are illustrated more fully in the drawings. Each example is provided by way of explanation of the invention, not limitation of the invention. This invention may, however, be embodied in many different forms and should not be construed as limited to the embodiments set forth herein; rather, these embodiments are provided so that this disclosure will be thorough and complete, and will fully convey the scope of the invention to those skilled in the art. In fact, it will be apparent to those skilled in the art that various modifications and variations can be made in the present invention without departing from the scope or spirit of the invention. For instance, features illustrated or described as part of one embodiment can be used with another embodiment and such variations come within the scope of the appended claims and their equivalents.

Like numbers refer to like elements to those skilled in the art. Like numbers refer to like elements throughout. The term "exemplary" as used throughout this document is defined to mean "example." It will be appreciated that terms such as "left", "right", "top", "bottom", "inwardly", "outwardly", "front", "inner", "up", and "down" and other positional descriptive terms used herein below are used merely for ease of description and refer to the orientation of the components as shown in the Figures. It should be understood that any orientation of the elements described herein is within the scope of the present invention.

As desired, embodiments of the invention may include the system with more or less of the components illustrated.

Referring to FIG. 1, in one embodiment, a greeting set includes an envelope 12, a greeting card insert 14, and a tie fastener 16. The envelope 12 may resemble any variety envelopes of shapes or sizes including baronial, catalog, square, square flap, wallet flap, and the like. The envelope 12 may be constructed in any style and not limited to diagonal seam, center seam, side seam, or single side seam-constructed envelopes. The envelope 12 can be made of a variety of materials, such as paper, plastic, cardboard or the like.

Figure 2:
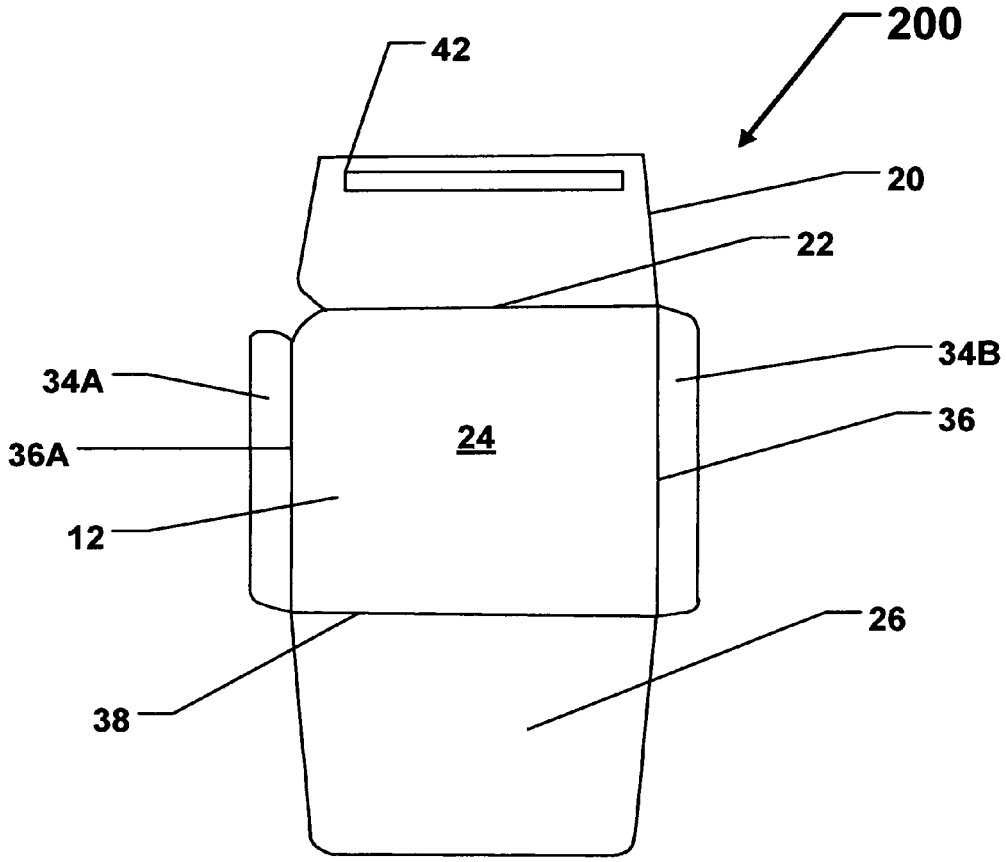
Figure 3A:
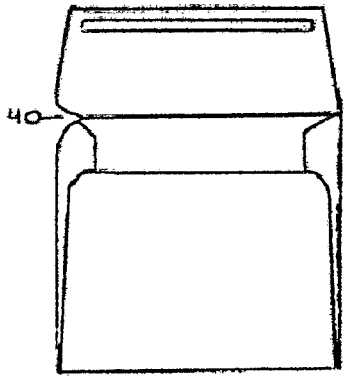
FIGS. 3A-3C. Open Back And Closed Back And Front View Of The Closed Envelope From FIG. 1 Respectively FIG. 4. A Single Panel Greeting Card Insert FIG. 5. A Double Panel Greeting Card Insert FIG. 6. A Tie Fastener FIG. 7. A Back View Respectively Of A Set Of The Greeting Card Insert, With Integrated Tie Fastener, Partially Inserted Within The Envelope FIG. 8. A Back View Respectively Of A Set Of The Greeting Card Insert And Fastener Completely Inserted Into The Envelope With The Envelope In A Closed Disposition With The Tie Fastener Released Thru The Opening In The Envelope FIGS. 9A-D. Front, Side And Back Views Respectively Of A Set Of The Greeting Card Insert, With The Tie Fastener, Within The Envelope FIGS. 10A-B. The Greeting Card Insert Fastened To The Strap Of A Gift Bag Within And Without The Envelope Respectively FIG. 11. The Set As It May Be Fastened To A Bottle FIG. 12. The Set As It May Appear If Presented Solely With Tie Fastener Tied in a Bow.
Figure 3B:
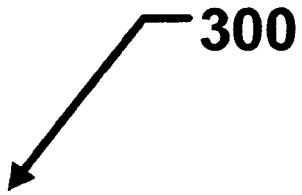
Figure 3B:
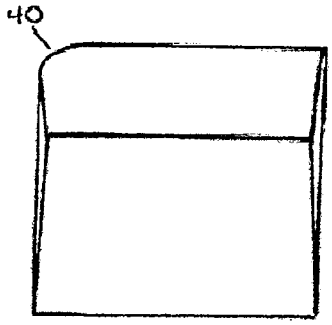
Figure 3C:
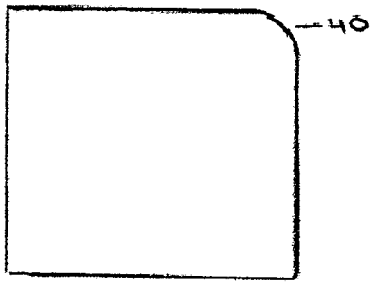

The envelope 12 includes a body portion 18 and a flap portion 20 pivotally coupled to the body portion 18 along a fold line 22. The body portion 18 includes a front panel 24 and a rear panel 26 that define a cavity 28 therebetween, the cavity 28 having a mouth 30. The flap portion 20 is pivotal about the front fold line 22 between a closed position, wherein the flap portion 20 covers the mouth 30 to generally seal the cavity 28, and an open position shown. The rear panel 26 and side panels 34*a*, 34*b* when folded at rear fold line 38, and side fold lines 36*a*, 36*b* meet to create a free edge 32. The mouth 30 of the cavity 28 may be positioned between the front fold line 22 and the free edge 32. Alternately the mouth 30 can be defined along or about the free edge 32 and the portions of the front panel opposite the free edge 32. The flap portion 20 may be sized such that when the flap portion 20 is in its closed position at least part of the flap portion 20 lies on top of, and/or overlaps the rear panel 26. The flat pattern of the envelope 12 is shown in FIG. 2.

Referring to FIGS. 1-3C, the flap portion 20, front panel 24, side panel 34*b* are each contoured as such so that when the flap portion 20 is folded at fold line 22, and side panels 34*a*, 34*b* are folded at side fold lines 36*a*, 36*b*, and rear panel 26 is folded at rear fold line 38 an opening or channel 40 is formed in the top corner of the envelope 12. When the flap portion 20 is closed, the cavity 28 is largely bounded by the inner surfaces of the front panel 24, the rear panel 26, the side panels 34*a*, 34*b*, and part of the underside of the flap portion, with the exception of the opening or channel 40. The opening or channel is also illustrated in FIGS. 9A-9D. The underside of flap portion 20 may include, for example, a moisture activated adhesive 42, a pressure sensitive adhesive 42 or other securing means located thereon and positioned to secure the flap portion 20 to the outer surface of the rear panel 26. The adhesives 42 could be located at locations other than the underside of the flap portion 20.

A greeting card insert 14 may be made of any of a variety of materials including sheets of thin or flexible material such as paper, glossy paper, paperboard, plastic, cardboard, and the like. The insert 14 may also be fabricated of polymer, fabric or other materials, and may be sized to fit in the envelope 12. The insert 14 could be a single panel or multi-panel sheet (i.e., said insert 14 can include one or more fold lines). However, the insert 14 is not limited to these specific characteristics and can take the form of nearly any component that is or can be inserted into or used with the envelope 12.

Figure 4:
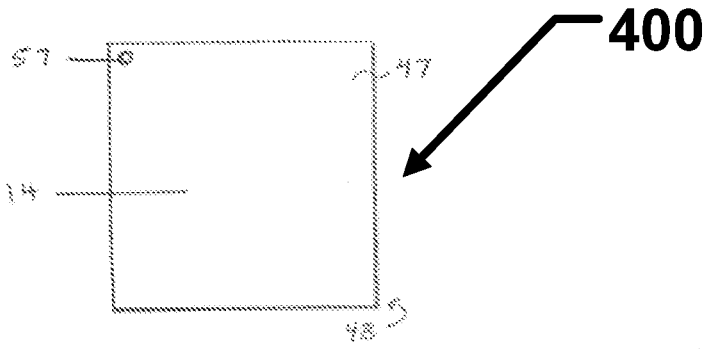
Figure 5:
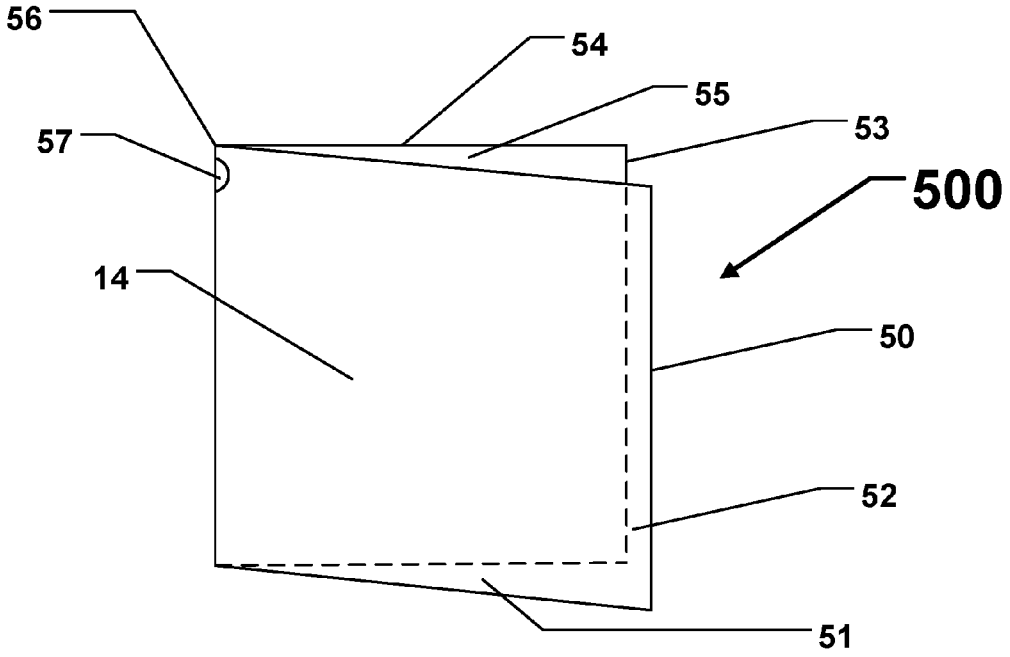
Figure 6:
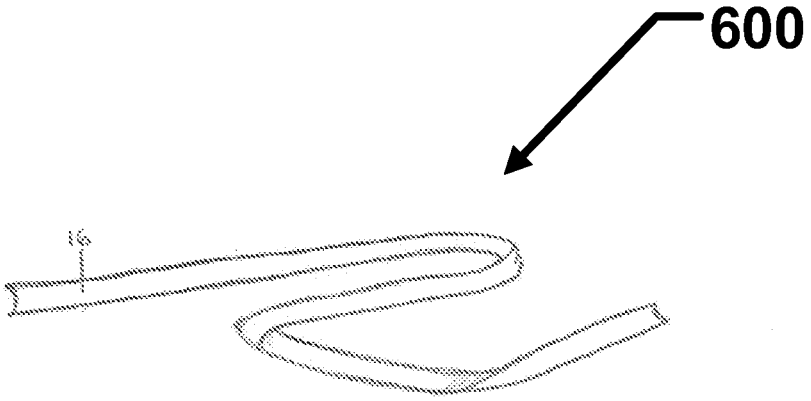
Figure 7:
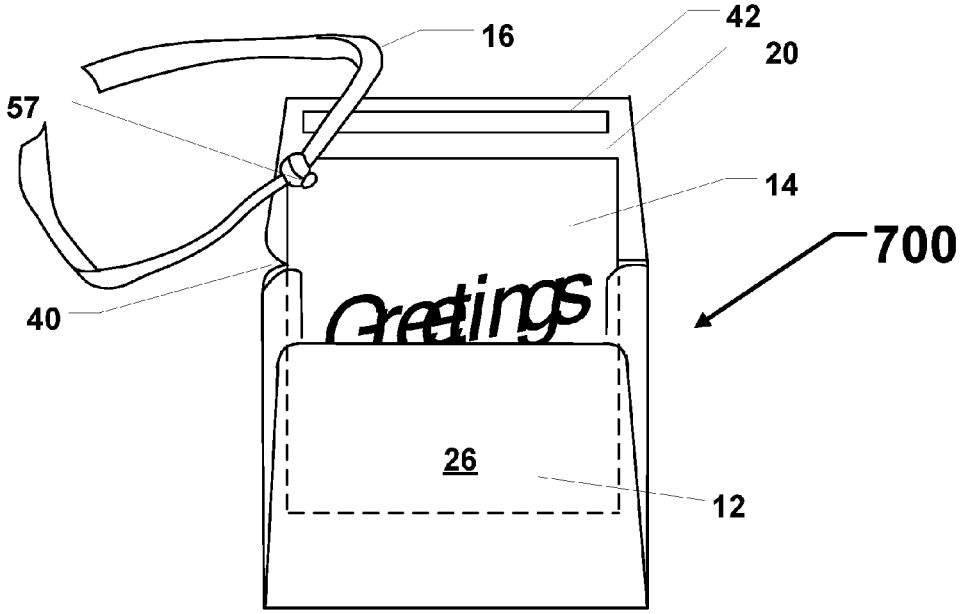
Figure 8:
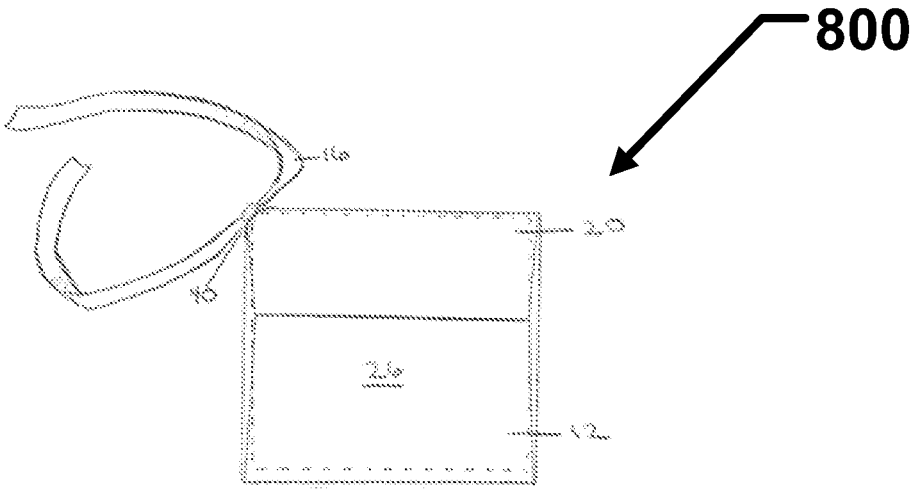
Figure 9A:
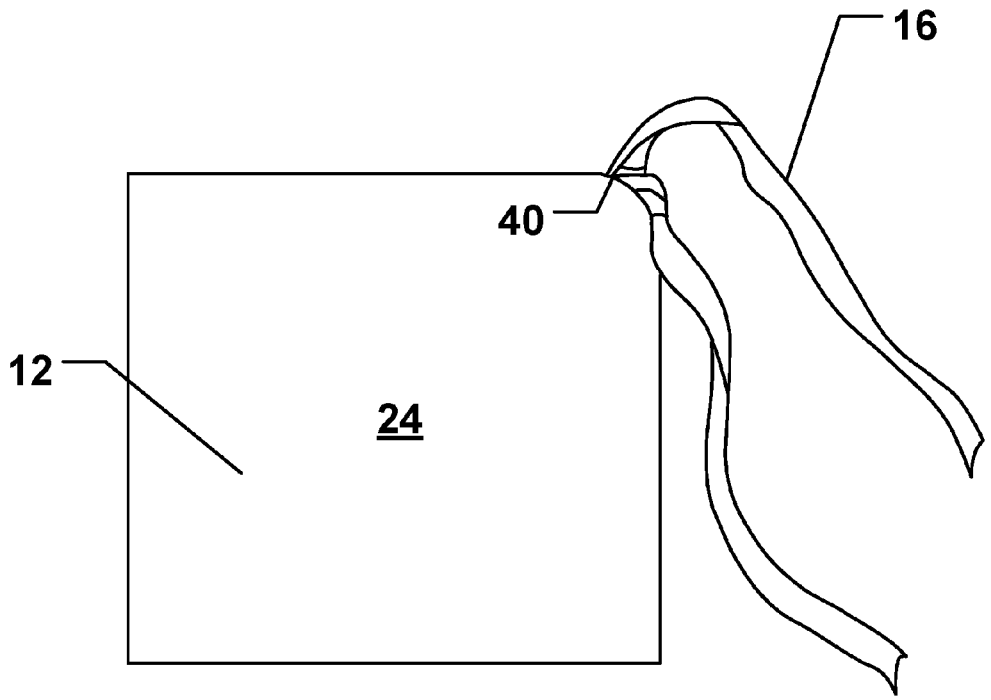
Figure 9B:
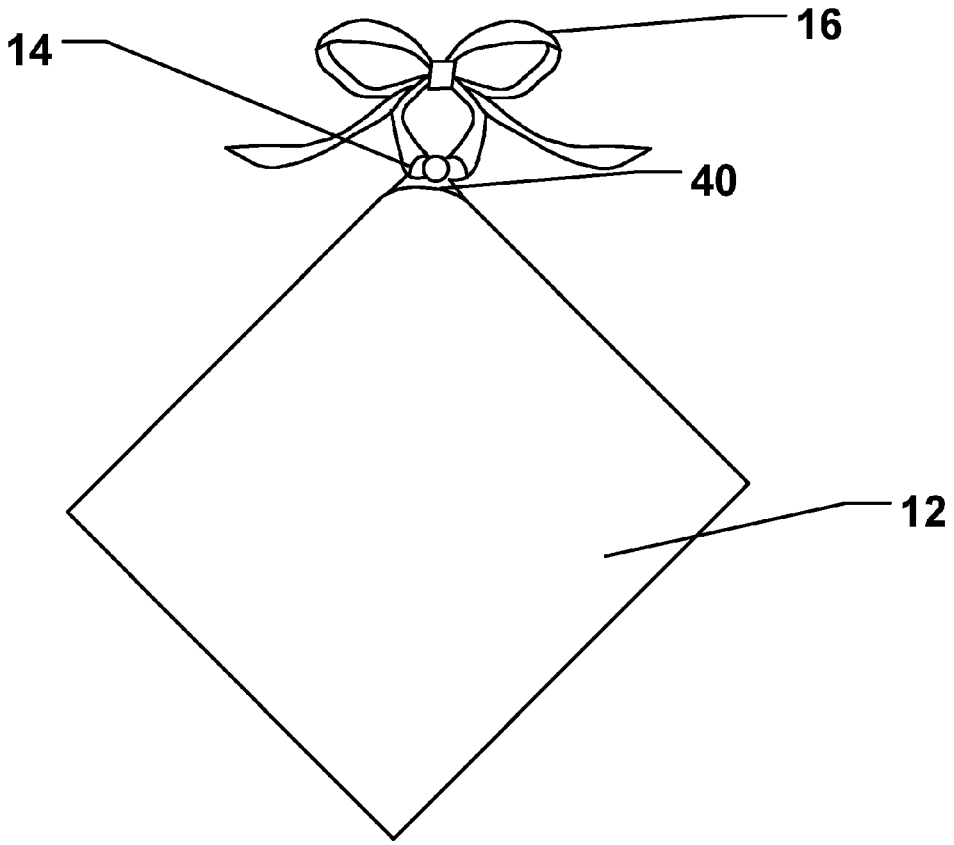
Figure 9C:
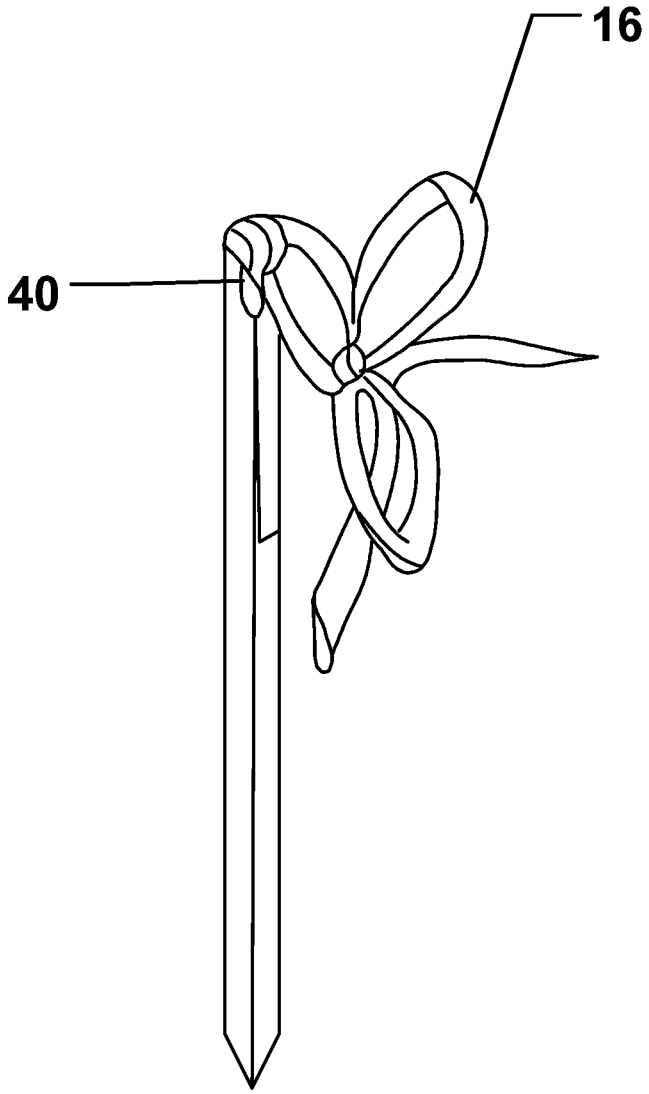
Figure 9D:
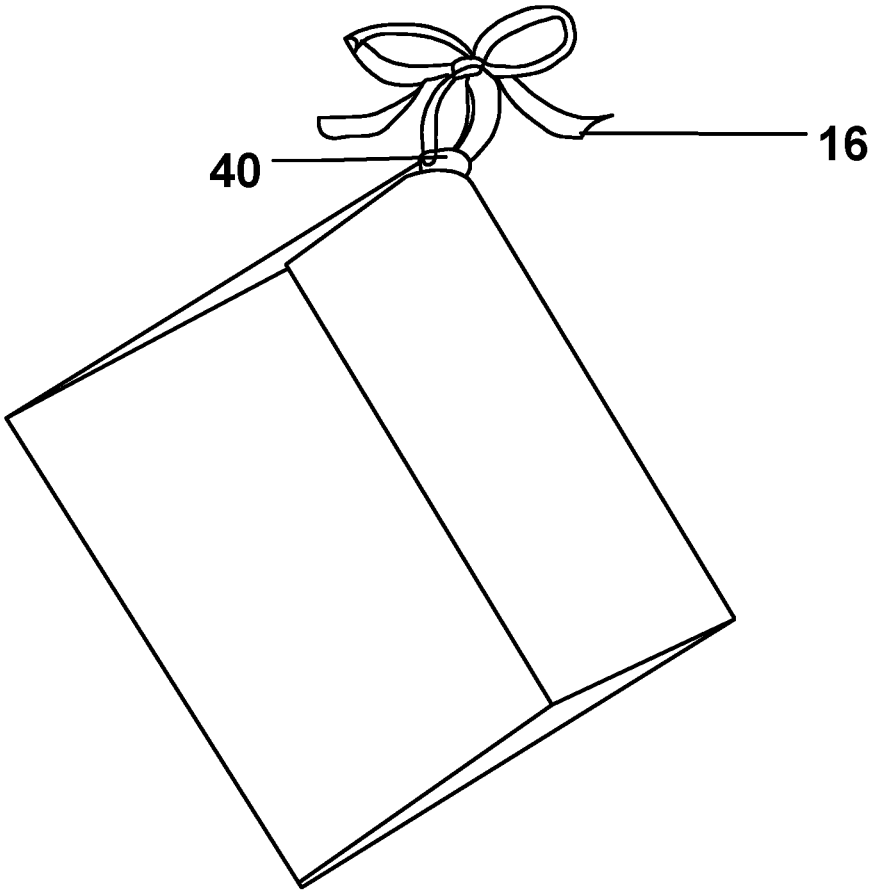

A greeting card insert 14 can be single panel, which has a front surface 47 and back surface 48 as seen in FIG. 4 or multi panel, for example, as seen in FIG. 5 double panel containing a front panel 50 that has a front surface 51 and front interior surface 52, and a rear panel 53 that has a rear surface 54 and rear interior surface 55 connected at a fold line 56. Panels 50 and 53 are movable about the fold line 56 such that the greeting card insert 14 may be adjusted between a folded condition and an unfolded condition. At least a portion of the front panel 50 and rear panel 53, or the front surface 47 and back surface 48 of the corresponding greeting card insert 14 is constructed of a material that is suitable for receiving ink or other printing compositions. Various greetings, sentiments, messages, and images may be disposed on the front 47 and back 48 surface, and the front surface 51, rear surface 54, the interior surfaces 52 and 55, or any combination thereof of the corresponding greeting card insert 14. For example the front surface 51 may include an area for text for a label, message, image, or any combination thereof. For example the front surface 51 may include a message printed such as "HAPPY BIRTHDAY", "HAPPY ANNIVERSARY", "CONGRATULATIONS", an image, or any combination thereof. Similarly, at least one of the interior surfaces 52 and 55 of a greeting card insert 14 may include a message conveying various greetings, sentiments, messages and images, or may include no preprinted areas providing the gift giver more room to handwrite a personalized message. In the example of the double panel greeting card insert 14 the front and rear panels 50 and 53, can be decorated in various colors to provide a pleasant or festive appearance. Images and decorative additions such as ribbons, lace, colored tissue paper and the like may be included on one or more of the panels 50 and 53.

Referring to FIG. 1, in an embodiment of the present invention, the greeting card insert 14 contains an aperture 57. A tie fastener 16 is inserted through the aperture 57 and tied off thereby forming a means to fasten a set of the greeting card insert 14 with envelope 12 to an article such as a gift bag, box, teddy bear, or bottle of wine. FIG. 5 depicts the aperture 57 at the fold line 56 of the double or multi panel insert 14, through which a tie fastener 16 can be inserted and tied off forming a means to fasten said set to the article. The tie fastener 16 can be composed of any suitable material including, but not limited to, a textile ribbon, thread, or cord, a metal and/or plastic string, polymer band, and any combination thereof. A tie fastener 16 may be composed of varying lengths and widths, but should be configured to pass through the aperture 57 of the greeting card insert 14, and long enough to affix the set.

Figure 10A:
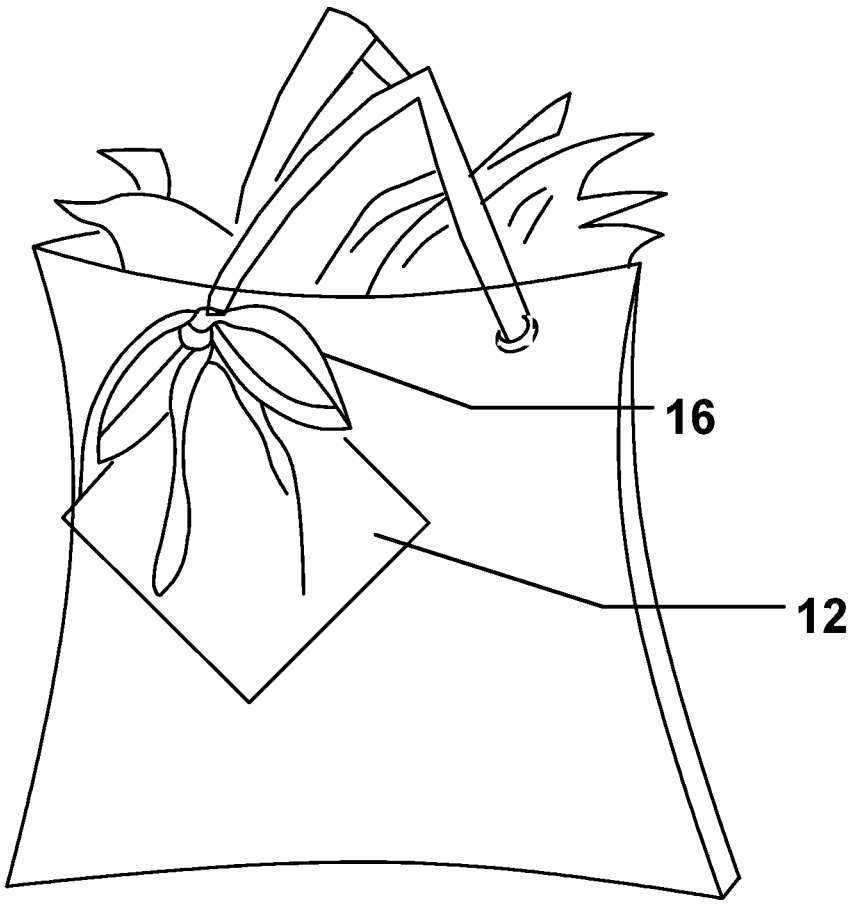
Figure 10B:
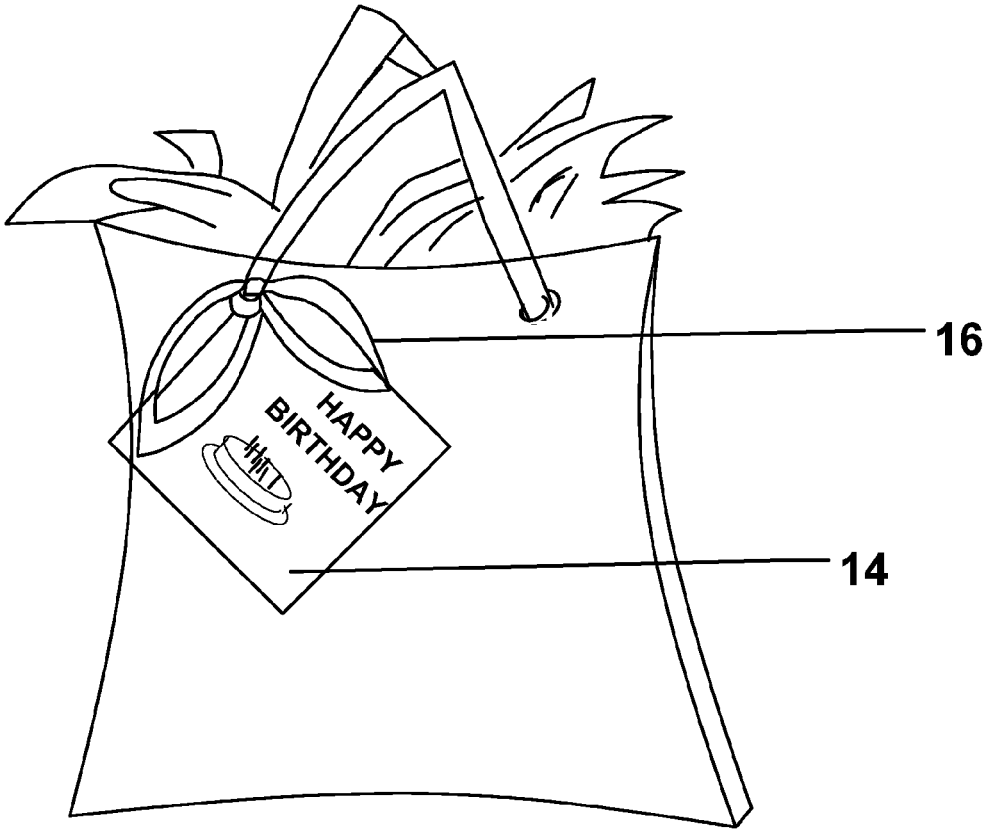
Figure 11:
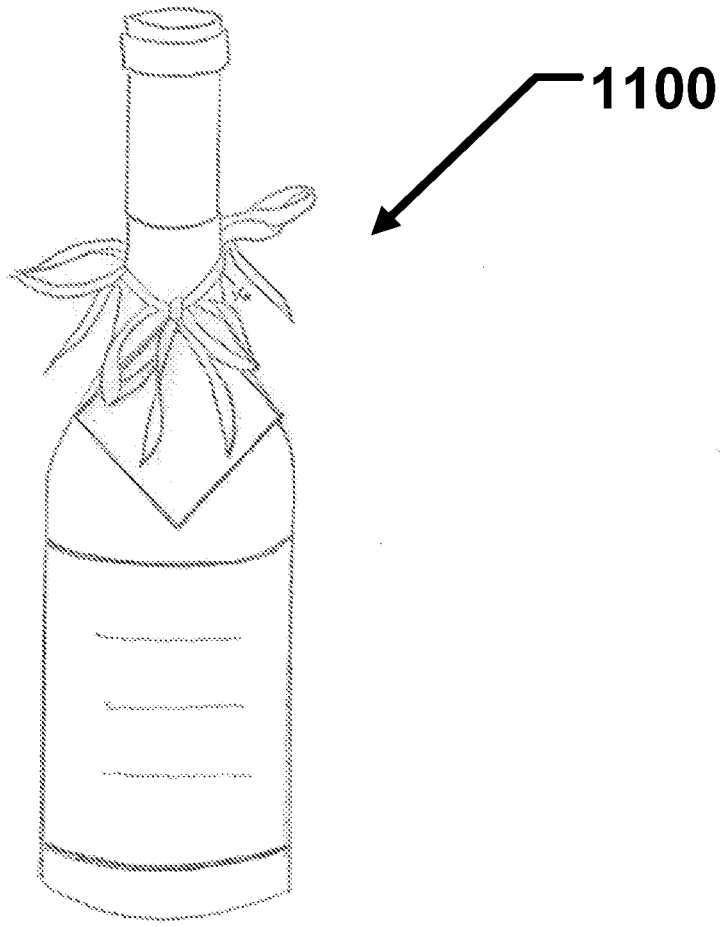
Figure 12:
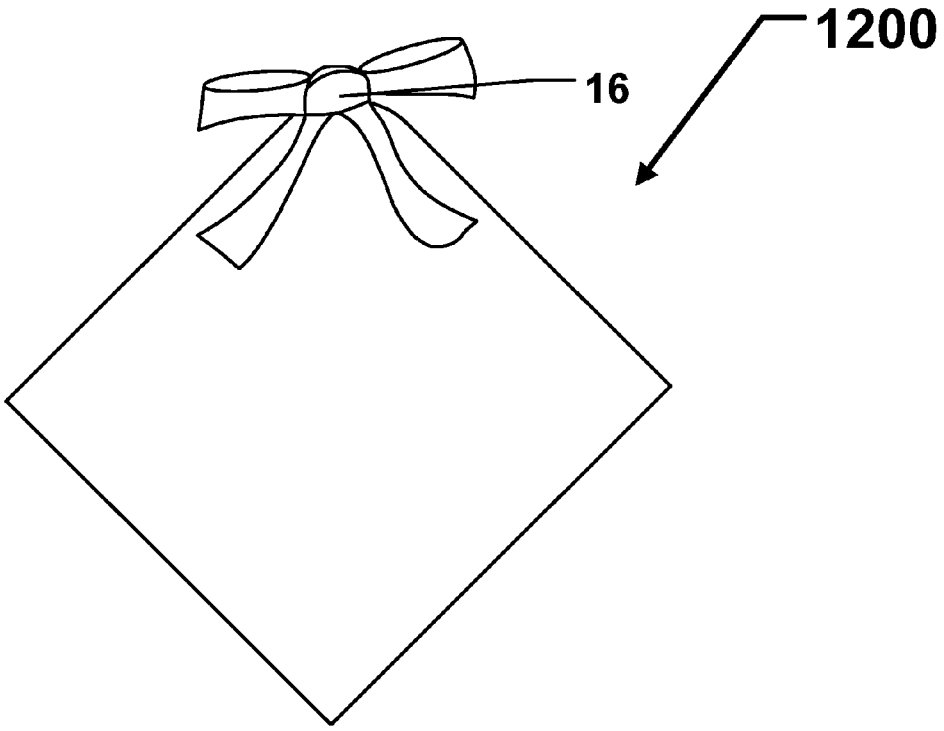

FIGS. 9A-D depict front, side, and back views of the greeting card insert 14 within the envelope 12 respectively. FIG. 10A illustrates the set fastened to the strap of a gift bag. The gift receiver has an option of removing the entire set from the gift bag by untying the tie fastener 16. The gift receiver may reattach the set after opening, or reattach only the greeting card insert 14 if desired. The gift receiver has another option of choosing to keep the greeting attached via the tie fastener 16 while simply removing envelope 12 thereby maintaining the greeting card insert 14 affixed to the gift bag at all times as FIG. 10B illustrates. FIG. 11 shows the set as it may be fastened to a bottle of wine by way of tying the tie fastener 16 around the bottle's neck. FIG. 12 illustrates the set as it would be used for presenting a greeting card that a gift giver may want to include a gift card inside, with the tie fastener 16 tied into a bow to add a decorative element to its presentation.

Figure 13:
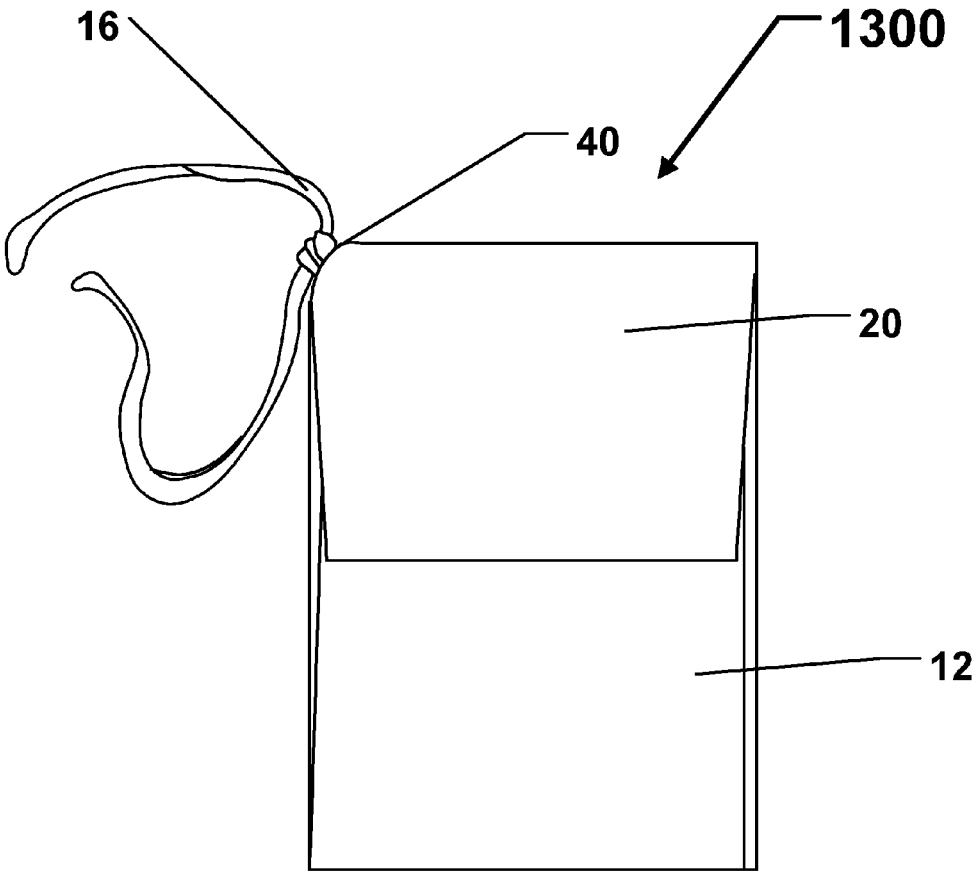
FIGS. 13-14. Alternative Embodiments Of The Set
Figure 14:
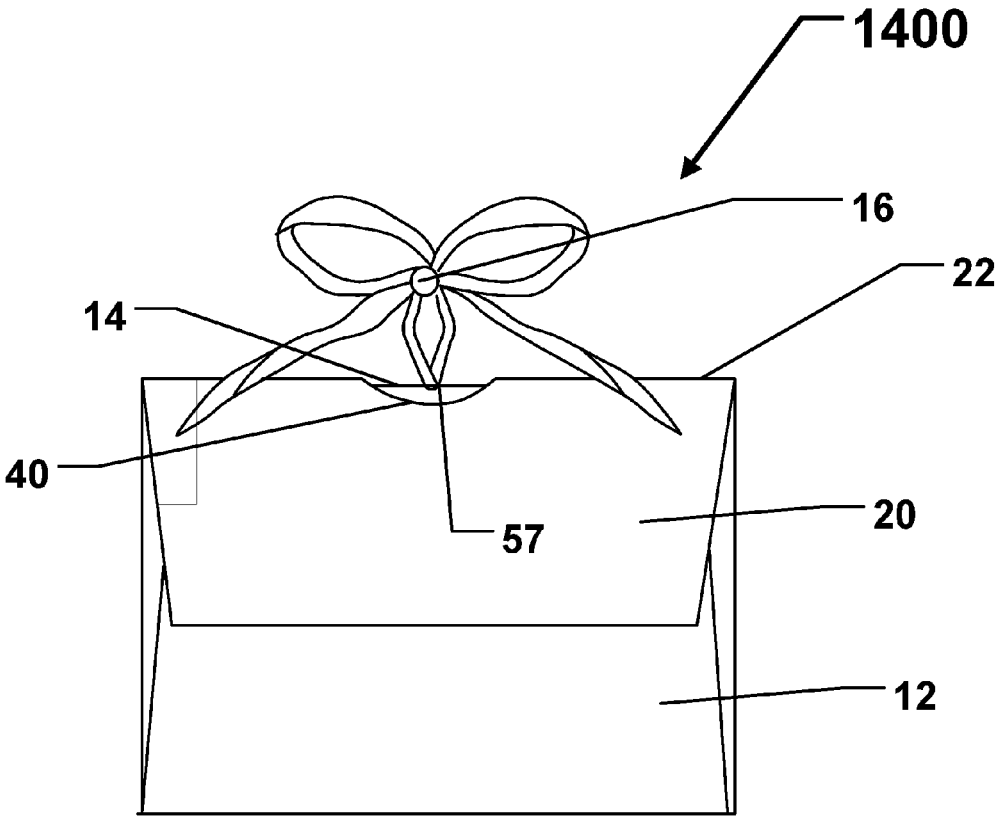

Other embodiments are shown in FIGS. 13-14. In each case the greeting card insert 14 has an aperture 57 with a tie fastener 16 inserted through the aperture 57. The envelopes 12 in each case are contoured such that when in folded and closed disposition an opening is created whereby the greeting card insert 14 and tie fastener 16 become exposed enabling fastening of the set. In FIG. 13 the envelope 12 is constructed to form a rectangular shape when in a folded and closed disposition wherein the flap portion 20 is on the shorter side. In FIG. 14 an opening is created through the front panel 24 and flap portion 20 of the envelope 12 at the front fold 22 thereby exposing a greeting card insert 14 and tie fastener 16. A greeting card insert 14 may also require more than one aperture 57 to accommodate a tie fastener.

Figure 15:
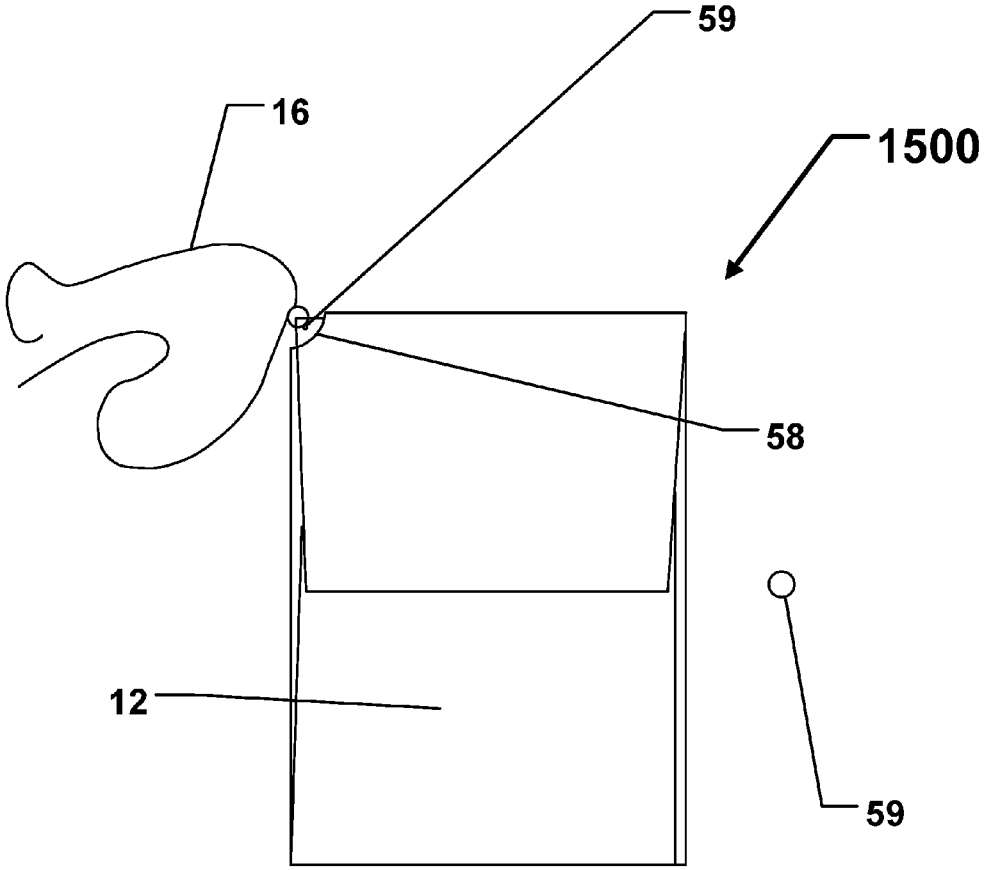
FIGS. 15-16. Alternative Embodiments Of The Set Using Alternative Fasteners
Figure 16:
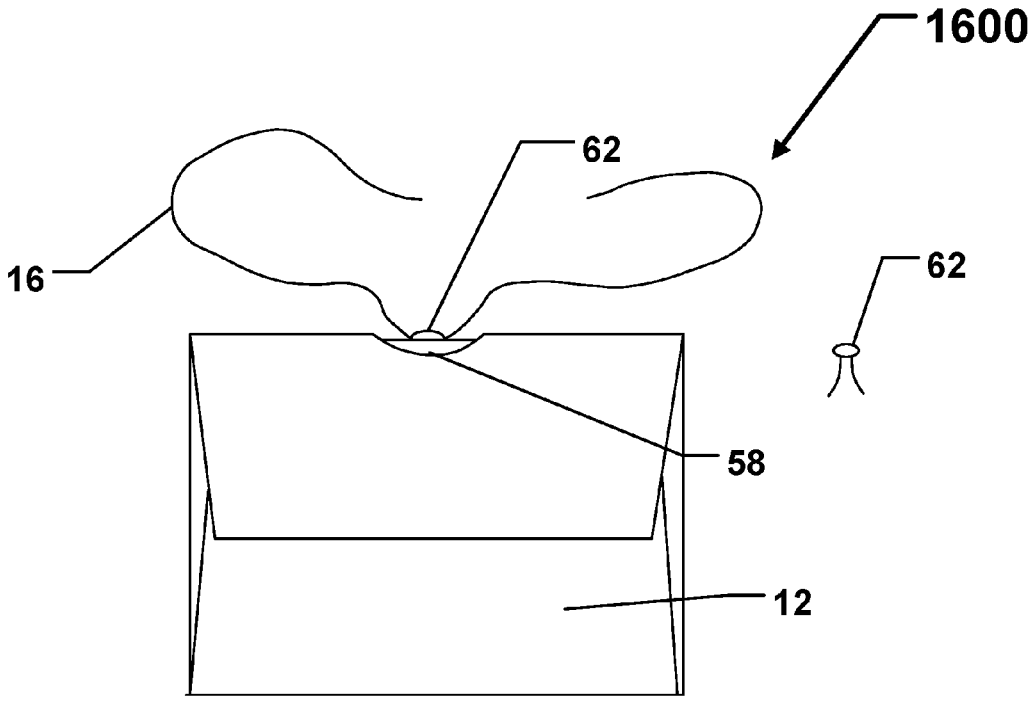

There are many possible variations that may be constructed to expose the greeting card insert 14 and tie fastener 16 by way of an opening 40 in the envelope 12. Said concept can be applied for any alternative objective whereby it would be desired to affix any insert 58 enclosed in an envelope 12 by way of an exposed tie fastener 16 including but not limited to, for example, a ring 59 in FIG. 15, or round fastener 62 in FIG. 16, for which a tie fastener 16 may be integrated as a means for fastening.

Accordingly, the greeting card and envelope system of the various embodiments can be used to affix greeting cards to various articles. Said system can be used easily and conveniently, and can be unfastened and refastened as desired without causing damage to the article. The greeting card and its contents remain affixed to the article thereby maintaining any valuable contents of the envelope that may be in addition to the greeting card. The concept of insert and envelope system can be applied for any objective in which said system is desired, and therefore not limited to use with greeting cards.

While several inventive embodiments have been described and illustrated herein, those of ordinary skill in art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto: inventive embodiments maybe practiced otherwise than as specifically described and claimed. Inventive embodiments of the present disclosure are directed to each individual feature, system, article, material, kit, and/or method described herein. In addition any combination of two or more such features, systems, articles, materials, kits, and/or methods are not mutually inconsistent, is included within the inventive scope of the present disclosure.

Accordingly, as indicated above, the foregoing embodiments of the invention are examples and can be varied in many ways. Such present or future variations are not to be regarded as a departure from the spirit and scope of the invention, and all such modifications as would be apparent to one skilled in the art are intended to be included within the scope of the following claims.

As used herein in the specification and in the claims, the phrase "at least one", in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements "at least one of A or B", or, equivalently "at least one of A and/or B" can refer, in one embodiment to at least one, optionally including more than one, A, with no B present (and optionally including elements other than B); in another embodiment, to at least one, optionally including more than one B, with no A present (and optionally including elements other than A); in yet another embodiment, to at least one, optionally including more than one, A, and at least one, optionally including more than one, B (and optionally including other elements); etc. . . . It should also be understood that unless clearly indicated to the contrary, in any methods claimed herein that include more than one step or act, the order of the steps or acts of the method is not necessarily limited to the order in which the steps or acts of the method are recited. In the claims, as well as the specification above, all transitional phrases such as "comprising," "including," "carrying," "having," "containing," "involving," "holding," "composed of," and the like are to be understood as open-ended, i.e., to mean including but not limited to. Only the transitional phrases "consisting of" and "consisting essentially of" shall be closed or semi-closed transitional phrases respectively.

I claim:

1. A method of presenting a communication insert attached to an article comprising the steps of:

(a) providing a communication message insert configured for inscribing a message thereon;

(b) attaching a fastener to said insert;

(c) providing an envelope comprising a body portion having a front panel, one or more rear panels, one or more side panels, and a flap portion, defining an inner cavity therebetween, wherein the one or more flap portions are directly coupled to said front panel along a fold line, to seal the inner cavity with the exception of an opening formed in said envelope wherein said fastener remains visible and operable to attach to said article outside said envelope;

(d) providing adhesive on the one or more flap portions;

(e) inserting said insert with said fastener attached thereto into said envelope;

(f) sealing the one or more flap portions with said adhesive so that said opening is formed in one or more corners or sides of said envelope, with said fastener remaining outside the envelope and being aligned with said opening to be visible outside the envelope in a closed or sealed disposition;

(g) fastening said fastener to the article whereby the envelope may be removed from the insert while the insert remains attached to the article by the fastener.

* * * * *